US005503439A

United States Patent [19]

LaJeunesse et al.

[11] Patent Number: 5,503,439

[45] Date of Patent: Apr. 2, 1996

[54] WEDGE BAR LOCKING MECHANISM FOR BURIAL CASKET

[75] Inventors: John P. LaJeunesse, Batesville; Francis Hensley, Milan; Louis Scheele, Batesville; Harold E. Metcalf, Metamora; Edward Lodics, Batesville, all of Ind.

[73] Assignee: Batesville Casket Company, Inc., Batesville, Ind.

[21] Appl. No.: 348,613

[22] Filed: Dec. 2, 1994

[51] Int. Cl.[6] ..... E05C 3/00

[52] U.S. Cl. ..... 292/44; 292/160; 292/DIG. 53

[58] Field of Search ..... 292/44, 160, DIG. 53, 292/156, 142, 157, 162

[56] References Cited

U.S. PATENT DOCUMENTS

| | | | |
|---|---|---|---|
| 2,284,921 | 6/1942 | Purkiss | 27/17 |
| 2,323,674 | 7/1943 | Purkiss | 292/157 |
| 2,417,756 | 3/1947 | Hillenbrand | 292/157 |
| 2,582,841 | 1/1952 | McEwan | 292/157 |
| 2,585,403 | 2/1952 | Paul | 292/247 |
| 2,587,355 | 2/1952 | McEwan | 292/157 |
| 2,728,971 | 1/1956 | Harter | 27/17 |
| 2,848,782 | 8/1958 | Gillison | 27/17 |
| 3,521,920 | 7/1970 | Morand | 292/39 |
| 3,845,976 | 11/1974 | Peterson | 292/58 |
| 3,944,267 | 3/1976 | Sunquist | 292/158 |
| 3,981,054 | 9/1976 | Hull et al. | 27/17 |
| 4,486,040 | 12/1984 | Strangward | 292/160 |
| 5,060,993 | 10/1991 | Maier | 292/241 |
| 5,265,923 | 11/1993 | Paddock | 292/336.3 |
| 5,457,861 | 10/1995 | Lloyd | 27/10 |

*Primary Examiner*—Steven N. Meyers
*Assistant Examiner*—Monica E. Millner
*Attorney, Agent, or Firm*—Wood, Herron & Evans

[57] ABSTRACT

An improved wedge bar locking mechanism for a burial casket requires only a bracket, a screw and a clip which cooperate with one end of a wedge bar to cause longitudinal movement of the wedge bar in two directions for locking end unlocking the lid of a casket to the body of the casket. The components of the mechanism are located in the body of the casket, adjacent an end wall. The bracket mounts rigidly to the body. The screw threads directly to the wedge bar, and the bracket and clip hold opposite ends of the screw to prevent axial and radial movement thereof so that rotational movement of the screw is converted to longitudinal movement of the wedge bar. The screw is accessible for rotation via a keyway in the end wall. A center wall of the bracket engages the end of the wedge bar to prevent rotational movement thereof when the screw is rotated. The bracket also includes integral tabs which serve as over-travel stops for both the locked and unlocked positions of the wedge bar. This improved mechanism is less susceptible to failure than prior structures, and it requires fewer components, which translates to a cost savings due to reduced manufacturing and assembling expense.

15 Claims, 2 Drawing Sheets

WEDGE BAR LOCKING MECHANISM FOR BURIAL CASKET

FIELD OF THE INVENTION

This invention relates to burial caskets, and more particularly, to an improved mechanism for locking the lid of a casket to the body of the casket.

BACKGROUND OF THE INVENTION

Burial caskets include a lid hingedly connected to a body along one longitudinal edge, to permit hinged movement of the lid to a closed position along the other longitudinal edge. The lid and the body include structural components which cooperate to permit the lid to be locked, or tightly sealed, to the body in the closed position so that the closed casket is airtight.

When the casket is initially closed, the body and the lid are in uninterrupted engagement along confronting flange surfaces which extend completely around the four walls of the casket. A compressible gasket or sealing tube also extends completely around the casket and resides between the engaged flange surfaces of the body and the lid. During locking, the lid is pulled downwardly toward the body to compress the gasket and to provide an airtight seal extending completely around the four walls of the casket.

For metal caskets, a wedge bar is commonly used to lock the lid to the body. The wedge bar resides within a hollow portion of the body of the casket, adjacent the flange, and it extends almost the entire length of the open, or nonhinged, side of the casket. Hangers located inside the body hold the wedge bar at a desired vertical position, but allow horizontal movement along the axis of the wedge bar. The wedge bar includes at least one, and preferably three or four, catches having cam surfaces. The catches may be integrally formed with the wedge bar or separately attached thereto. Each catch resides immediately below a small opening in the flange along the nonhinged edge of the body. The nonhinged edge of the lid includes a corresponding number of keeper elements mounted thereto and directed downwardly, and these elements are aligned with the openings and catches. When the lid is closed, the keeper elements extend downwardly through the openings, with each keeper element positioned adjacent a catch.

Longitudinal movement of the wedge bar in a first direction toward a first end wall of the casket causes the catches to engage the keeper elements, and the keeper elements are cammed downwardly by the catches until the wedge bar stops moving. This camming action pulls the lid downwardly to the sealed position. A screw mounted within the body has a head end which is accessible through a port in the first end wall. This screw operatively connects to one end of the wedge bar, and the screw is held in place relative to the body by a bracket, which is fixedly secured to the body. Rotating the screw in one direction moves the wedge bar toward the first end wall, which locks the casket. Rotating the screw in an opposite direction moves the wedge bar toward the opposite end wall, which unlocks the casket. The screw is rotated from outside the first end wall, via the port therein.

Additional structural components are also housed within the body adjacent the first end wall, and these components are associated with the screw, the wedge bar or the bracket. These additional components are used to couple the screw to the wedge bar, to serve as a bearing therebetween, to prevent the wedge bar from rotating about its longitudinal axis, to prevent movement of the screw from its axis and to limit movement of the wedge bar toward or away from the first end wall during sealing or unsealing, respectively.

Burial caskets are typically displayed prior to being sold, so that the customer may select a preferred model. In displaying burial caskets, it is often necessary to demonstrate the locking capability. For some caskets, numerous demonstrations occur prior to sale. To maintain the reputation of the casket manufacturer, it is absolutely critical that the locking components perform repeated demonstrations without failing. The ability of the locking mechanism to perform repeated demonstrations without failure on one casket also provides a favorable indication that the same mechanism will not fail when used on other caskets, which for one reason or another may not be subjected to such demonstrations.

Additionally, regardless of whether or not the locking capability of a casket is publicly demonstrated, it is important that the casket remain locked in an airtight condition during actual use. Otherwise, a number of environmental and/or health concerns may arise, some of which are regulated by public law. These concerns are particularly relevant if the casket, in actual use, is not buried in the ground but simply placed in a mausoleum. Thus, the combination of structural components associated with locking and unlocking a casket must perform reliably and must hold up over an extended period of use.

In one prior locking casket locking design, seven separate parts are used to accomplish the above-described functions, excluding the wedge bar itself and fastening screws used to hold the bracket to the body. More specifically, this prior design uses a rivnut to couple the screw to the wedge bar. This rivnut is press fit into the end of the wedge bar and threadably receives an externally threaded screw. The screw also extends through a washer, a hole in one end wall of the bracket and a stop collar prior to threadable connection to the rivnut. The washer serves as a bearing surface between the rotatable screw and the fixed bracket. A roll pin secures the stop collar to the screw. A rivet secures to the wedge bar, and the rivet includes a head end which extends through a horizontal channel cut in a side wall of the bracket. This rivet and channel prevent twisting of the wedge bar during rotation of the screw.

While this design has generally been acceptable in use, there is room for improvement. Namely, the stop collar and roll pin connected to the screw have been susceptible to failure. Also, coupling of the screw to the wedge bar requires machining and connecting the rivnut. Additionally, the rivet/channel structure for preventing twisting of the wedge bar requires several machining steps to form these parts, followed by the assembly steps of connecting and extending the rivet through the channel and connecting it to the wedge bar, with the wedge bar in place. In sum, the use of these seven separate parts for the purpose of locking and unlocking a casket represents a disproportionately high cost to the manufacturer, and ultimately to the consumer, particularly when considering that this design has failed on some occasions.

It is an object of this invention to significantly reduce the failure susceptibility of the structural components used to lock and unlock a burial casket.

It is another object of this invention to reduce the number of parts used to lock and unlock a burial casket, without sacrificing structural integrity or performance quality.

It is still another object of the invention to reduce the costs associated with manufacturing and assembling the components used to lock and unlock a casket.

SUMMARY OF THE INVENTION

This invention meets the above-stated objectives by using a simpified casket locking/unlocking mechanism of three-piece construction which includes a modified bracket, a modified screw and a bearing or retainer clip. The cooperative interaction of the bracket, the screw and the clip not only affects longitudinal movement of the wedge bar, but it also prevents twisting of the wedge bar, limits longitudinal movement of the wedge bar in both directions, limits movement of the screw from its axis and provides a bearing surface between the rotatable screw and the fixed bracket.

The three-piece locking/unlocking mechanism of this invention has a high degree of structural integrity, due to the manner in which the components cooperate to provide the above-described functions. As a result, compared to prior casket locking designs, this invention reduces the susceptibility for failure. This invention also represents an improvement over prior designs because enhanced structural integrity is achieved with fewer parts. Specifically, this invention eliminates the stop collar and the roll pin of the above-described prior design, the parts most susceptible to failure. Due to the reduction in parts, this invention also reduces the costs associated with manufacturing and assembling the components used to lock and unlock a burial casket.

According to a preferred embodiment of the invention, a wedge bar locking mechanism for a burial casket includes a screw with a reduced diameter forward end or pin, an externally threaded portion, an integral collar, a reduced diameter midportion and a smooth rearward portion which houses an Allen head. The bracket includes inner and outer vertical end walls integrally connected with a center wall. The center wall includes inner and outer pairs of spaced integral tabs. The inner end wall includes a hole sized to receive the pin located at the forward end of the screw. The outer end wall includes an upwardly opening slot sized to receive the midportion of the screw, with a cutout region thereabove. Both vertical end walls have an inwardly turned horizontal flange with a hole therein for fastener screws for securing the bracket to the body. The clip is made of bronze and includes two integral side members folded along one edge, with a slot cut into the opposite edge. In use, the slot opens downwardly.

The end of the wedge bar includes a pair of parallel vertical, spaced sections oriented perpendicular to the first end wall of the casket, with an interconnecting vertical section therebetween which is oriented parallel to the end wall of the casket. The interconnecting section has an internally threaded hole sized to receive the threaded portion of the screw.

The screw extends through the upwardly opening slot and the cutout in the outer vertical wall of the bracket, and the threaded portion is threaded through the hole in the interconnecting section of the wedge bar, so that the pin at the forward end is receivably retained in the reduced-diameter hole in the inner vertical wall of the bracket. In this position, the smooth outer portion of the screw is then lowered downwardly to locate the midportion within the slot in the outer vertical wall of the bracket. This locates the integral collar of the screw inside the outer wall and the rearward portion of the screw outside thereof. The bronze clip is moved downwardly over the outer end wall through the cutout region to place the downwardly directed slot over the screw midportion, with both side members sandwiching the outer wall and in turn being sandwiched between the collar and the outer smooth portion of the screw. The oppositely directed slots of the clip and the outer vertical wall completely encircle the midportion of the screw.

With the bracket secured to the body of the casket and the outer end of the screw accessible through a keyway in an end wall of the casket, this mechanism is ready to be used to reciprocally move the wedge bar horizontally along its axis to cause locking and unlocking of the casket. Rotation of the screw causes movement of the wedge bar.

Together, the captured pin at the forward end of the screw and the body of the casket itself prevent radial movement of the screw from its axis of rotation. The screw collar, midportion and outer portion coact with the outer wall of the bracket to prevent linear movement of the screw along its axis. The clip further restricts longitudinal, or axial, movement of the screw, provides quiet operation and also inhibits rust buildup. The inner and outer pairs of tabs of the center wall of the bracket limit longitudinal over-travel of the wedge bar away from and toward the first end wall of the casket, respectively. The inner vertical wall of the bracket, like each pair of tabs, has a width which is less than the spacing between the parallel sections of the wedge bar, so as not to prevent movement of the sections past the inner wall during unlocking movement of the wedge bar.

Also, the center wall is oriented perpendicular to the interconnecting section, and it has a width which is greater than the space between the parallel end sections of the wedge bar. With these parallel sections supported by, and in contact with, the center wall, the bracket prevents rotation of the wedge bar during rotation of the screw.

Thus, these three components form a wedge bar locking mechanism for a casket, and this mechanism performs all of the features required of casket locking and unlocking devices of this type. Namely, the mechanism controllably moves the wedge bar along its longitudinal axis for locking and unlocking, limits linear movement of the wedge bar past the locked and unlocked directions i.e. over-travel, prevents twisting of the wedge bar during screw rotation, and prevents the screw from moving radially or axially during rotation thereof.

Additionally, the wedge bar locking mechanism of this invention has improved structural integrity, fewer parts and lower manufacturing and assembly costs. The lower manufacturing costs result from the fewer number of components and the relatively simple manner in which the components of this mechanism may be produced. The lower assembly costs likewise result from the fewer number of components and the relatively straightforward manner in which these three components interact.

While the principles of this invention have been described with respect to a casket having a one-piece lid, it is to be understood that the invention also applies to caskets which use a lid with two separately foldable but connectable lid sections.

These and other features of the invention will be more readily understood in view of the following detailed description and the drawings.

DETAILED DESCRIPTION OF THE INVENTION

Figure 1:
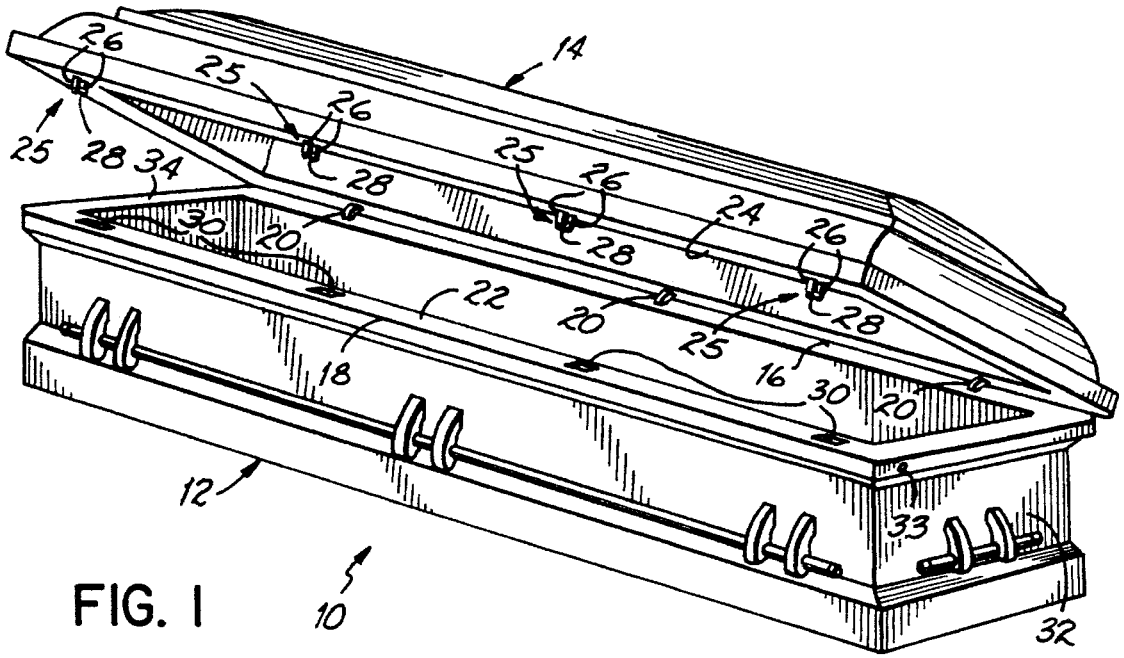
FIG. 1 is a perspective view of a partially open casket, illustrating the environment of the present invention.

FIG. 1 shows a burial casket 10 which may be equipped with the wedge bar locking mechanism of this invention. The wedge bar locking mechanism of this invention has particular advantages with respect to steel burial caskets, though the principles are also applicable to wooden burial caskets, or caskets made of any other suitable material, for that matter. The casket 10 includes a body 12 and a lid 14 hingedly connected to the body 12 along a hinge edge 16. The lid 14 closes upon the body 12 via hinged motion along the hinge edge 16, to place the body 12 and the lid 14 in contact along an opposite edge 18. A number of hinges 20 interconnect the body 12 and the lid 14 along the hinge edge 16, as is known in the industry.

The body 12 includes a flange 22, and the lid 14 includes a corresponding flange 24. The body flange 22 and the lid flange 24 reside in continuous engagement completely around the four walls of the casket 10 when the lid 14 is closed on the body 12. A compressible gasket (not shown) resides between the confronting flanges 22 and 24, as is known in the industry. The lid 14 includes a number of pulldown fasteners 25, mounted adjacent second edge 18. FIG. 1 shows four pairs of such pulldown fasteners 25 which are equally spaced along edge 18. Each fastener 25 preferably includes a pair of spaced studs 26 which hold a roller 28 therebetween, with the roller 28 oriented transverse to the longitudinal dimension of the casket 10. On the body 12, the flange 22 includes a like number of openings 30, and each opening 30 corresponds to one of the fasteners 25. Upon closing of the lid 14 to the body 12, the studs 26 and the rollers 28 associated therewith extend downwardly through the openings 30.

The body 12 of the casket 10 is further defined by a first end wall 32 and a second, opposite end wall 34. The first end wall 32 includes a keyway 33 located just below the horizontal surface of the body flange 22.

Figure 2:
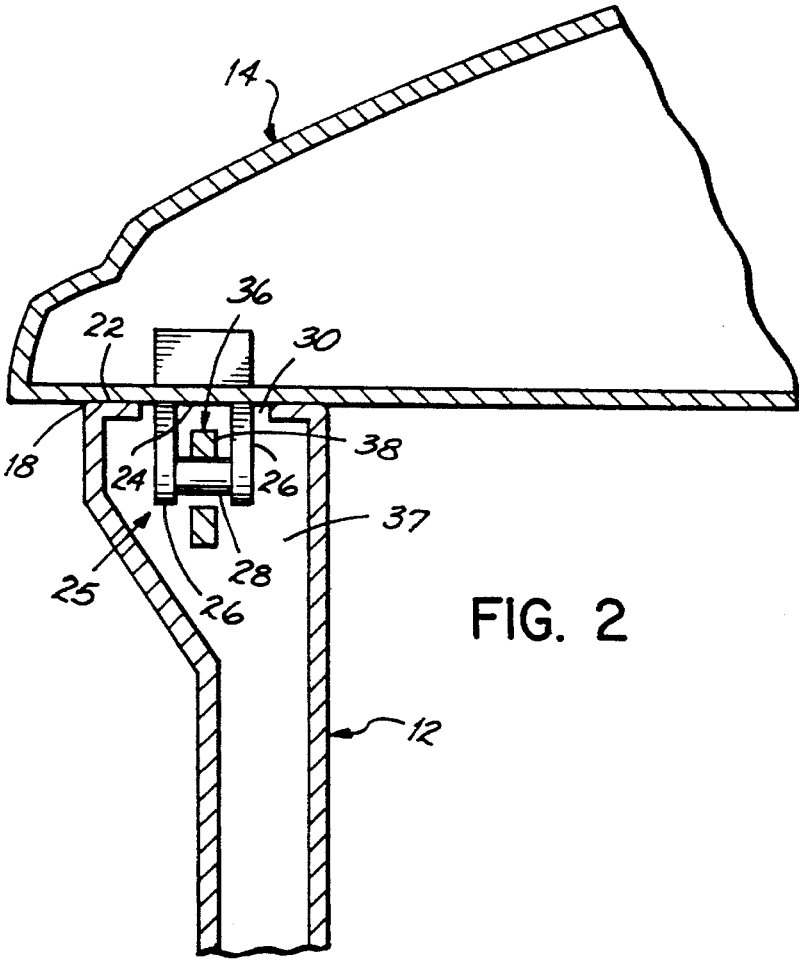
FIG. 2 is a transverse cross sectional view through a nonhinged edge of a closed casket, at one of the flange openings of the body, showing the relationship of the wedge bar and the rollers used to lock the casket closed.

As shown more clearly in FIG. 2, with lid 14 closed on body 12, each pair of studs 26 and the roller 28 associated therewith extends downwardly through one of the openings 30 in the body flange 22. A wedge bar 36 extends longitudinally along the length of the casket 10 along first edge 18. The wedge bar 36 resides below body flange 22 and within a recess or cavity 37 in the body 12. The wedge bar 36 is held at a desired vertical level within this opening 37 by hangers (not shown) which permit reciprocal motion of the wedge bar 36 along its longitudinal axis, or parallel with second edge 18.

This motion of wedge bar 36 causes locking and unlocking of the lid 14 to the body 12. More specifically, the wedge bar 36 includes a number of cutout regions which define catches 38, and each catch 38 corresponds to an opening 30 and an associated roller 28. Each catch 38 is defined in shape via a tapered edge 40 which serves as a cam surface and cooperates with a respective roller 28, which serves as a cam. When the wedge bar 36 moves longitudinally toward first end wall 32, the catches 38 engage the rollers 28 and gradually pull them downwardly, at a rate and distance dependent upon the angle of the tapered edges 40. This downward pulling of the rollers 28 also pulls the lid 14 downwardly with respect to body 12 so that their corresponding flanges 24 and 22 are compressed along second edge 18, along with the other three edges of the casket 10. This downward pulling compresses the gasket (not shown) residing between the body 12 and the lid 14 to lock the casket 10 in a sealed, airtight condition.

To unlock the casket 10, the wedge bar 36 is moved longitudinally in a direction away from first end wall 32, or in the direction toward second end wall 34. This causes the catches 38 to disengage the rollers 28, which allows the lid 14 to be lifted with respect to the body 12. The components and operation described thus far are well known in the burial casket industry, and do not form part of the present invention. The present invention relates to the simplification and improvement of the mechanism or components which affect longitudinal movement of the wedge bar 36 with respect to the body 12, and the other functions associated therewith.

Figure 3:
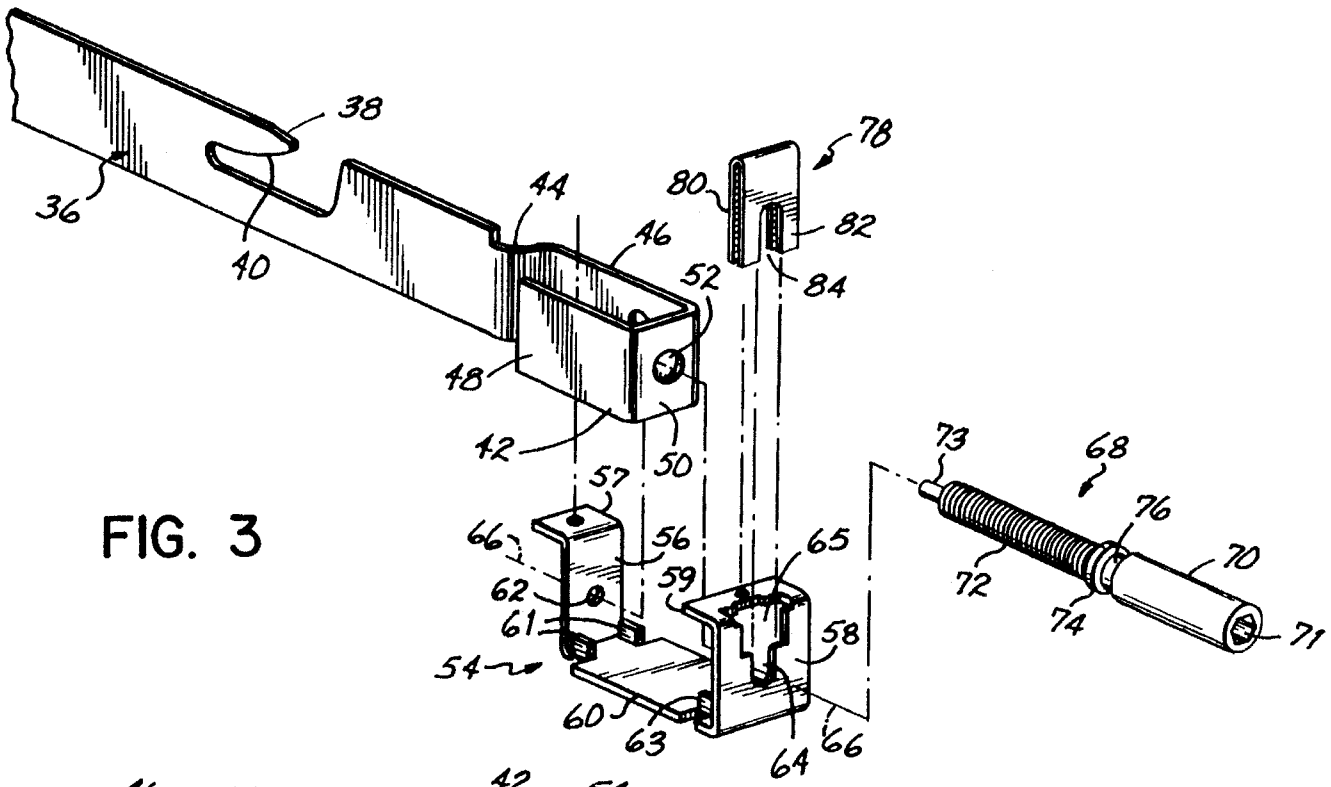
FIG. 3 is a disassembled perspective view which shows a preferred embodiment of a wedge bar locking mechanism for a casket in accordance with a preferred embodiment of the invention.

More particularly, FIG. 3 shows the components which make up this invention. According to the invention, a wedge bar 36 has a first end designated generally by reference numeral 42. This first end 42 includes an offset region 44 which primarily provides additional strength for the wedge bar 36. Adjacent the offset region 44, the first end 42 includes first and second spaced parallel sections 46 and 48, preferably vertically oriented, with an interconnecting section 50 spanning therebetween, also preferably vertically oriented. The interconnecting section 50 includes an internally threaded hole 52. The sections 46 and 48 are also perpendicular to end wall 32, while section 50 is parallel thereto. Preferably, the wedge bar 36 is formed to the configuration shown in FIG. 3 via a number of cutting and stamping steps, as known in the industry.

A bracket 54 is fixedly mounted to the body 12 adjacent the first end 42. The bracket 54 includes inner and outer vertical walls 56 and 58, respectively, each of which includes an upper horizontal flange 57 and 59, respectively. The inner wall 56 is further from first end wall 32 than outer wall 58. The width of inner wall 56 is less than the spacing between the first and second end sections 46 and 48, so as to not obstruct movement of the wedge bar 36 away from the first end wall 32 of the casket 10.

The inner wall 56 and outer wall 58 are interconnected by a center wall 60. In FIG. 3, the center wall 60 is horizontal, so as to be oriented perpendicular to the parallel sections 46 and 48. If the first end 42 is configured so that first and second sections 46 and 48 are horizontal, then center wall 60 should be vertical. The center wall 60 has a width greater than the spacing between the space between the parallel end sections 46 and 48, thereby to engage and to prevent rotational movement of the wedge bar 36 in either direction.

The center wall 60 includes a first inner pair of integral bent tabs 61 and a second outer pair of integral bent tabs 63. The pairs of tabs 61 and 63 also have a transverse spacing which is less than the spacing between parallel sections 46 and 48. The inner vertical wall 56 includes a hole 62, and the outer vertical wall 58 includes an upwardly opening slot 64, and a cutout region 65 located thereabove. The hole 62 and slot 64 are aligned along an axis 66. When the bracket 54 is secured to a bottom inside surface of body flange 22, via screws (not shown) which thread through the holes in horizontal flanges 57 and 59, the wedge bar 36 is arranged such that the interconnecting end section 50 resides adjacent center wall 60. Also, the threaded hole 52 in the interconnecting section 50 of the wedge bar 36 is aligned along axis 66 with hole 62 and slot 64. The axis 66 is also aligned with the keyway 33. The bracket 54, like the wedge bar 36, is formed via a number of punching and bending operations performed on a single piece of sheet metal.

A screw 68 also aligned with the keyway 33 operatively connects to the bracket 54 and the wedge bar 36. More particularly, the screw 68 includes a rearward end or portion 70 with an Allen head 71 located inside thereof, and a forward threaded portion 72. A reduced diameter pin 73 extends beyond threaded portion 72, at the forwardmost or inner end of the screw 68. This pin 73 is sized to be received within the hole 62 in the inner vertical wall 56. Screw 68 further includes an integral collar 74 located adjacent threaded portion 72, and a reduced diameter midportion 76 resides between the collar 74 and the rearward smooth portion 70.

Screw 68 is preferably formed by machining a blank on a screw machine. The initial machining step creates the collar 74 and the reduced diameter midportion, along with pin 73. The rearward smooth portion 70 is end drilled and then broached to form the transverse hexagonal shape of the internal Allen head. Thereafter, portion 72 is roll threaded, preferably in a manner which results in screw threads with a dimension of 7/16" or #5 Acme.

Figure 4:
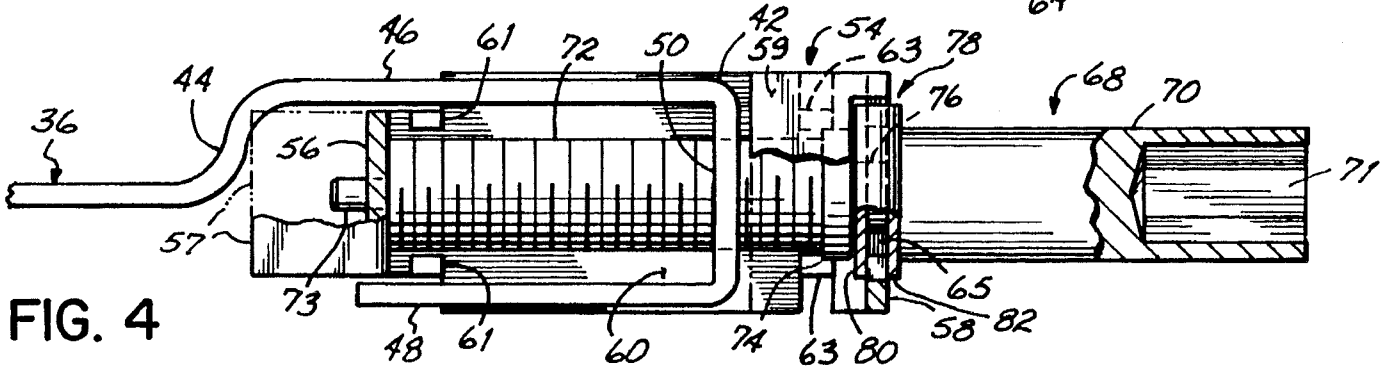
FIG. 4 is a top view in partial cross section of the mechanism shown in FIG. 3, with the components of the wedge bar locking mechanism of this invention in an assembled condition.

A bronze clip 78 includes inner and outer integral side members 80 and 82 folded along one edge and each cut to form a slot 84 located at an opposite edge, the slot 84 having an upper arcuate edge cut therein. In use, the slot 84 is downwardly directed. The clip 78 is sized so as to extend downwardly so that the inner and outer folded members 80 and 82 tightly sandwich the outer vertical wall 58, and the downwardly directed slot 84 closes off the upwardly directed slot 64, thereby encircling the midportion 76 of the screw 68. This relationship is shown most clearly in FIG. 4. FIG. 4 also shows that the longitudinal dimension of reduced diameter midportion 76 is sufficient to accommodate the combined longitudinal dimension of the clip 78 and the outer vertical wall 58. The clip 78 holds the screw 68 in place with respect to body 12 during rotational movement in either direction, to prevent axial movement thereof. The clip 78 is preferably formed by stamping and then folding a bronze blank. The invention contemplates the use of a clip 78 made of any material suitable for withstanding the necessary manufacturing steps of a casket, such as heat treatments, and also suitable for providing a quiet operation while inhibiting rust buildup. However, applicant is not presently aware of any material other than bronze which is suitable.

With the pin 73 residing in hole 62 and the clip 78 coactng with wall 58, the screw 68 is prevented from moving either axially or radially, and only rotational movement is permitted. The screw 68 may be rotated with an Allen head wrench via extension of the wrench through keyway 33. Because the forward threaded portion 72 extends through the threaded hole 52 of wedge bar 36, and because the screw 68 is prevented from moving axially or radially from longitudinal axis 66, rotation of the screw 68 causes longitudinal movement of the wedge bar 36 with respect to the body 12. Because the center wall 60 of bracket 54 has a width which is greater than the spacing between the first and second parallel sections 46 and 48 of wedge bar 36, the bracket 54 restricts twisting in either direction of wedge bar 36 about its longitudinal axis during rotation of the screw 68.

Additionally, the spaced pairs of integral tabs 61 and 63 serve as mechanical stops which limit longitudinal movement of wedge bar 36 via contact with interconnecting section 50. More specifically, when screw 68 is rotated to move wedge bar 36 toward second end wall 34, the transverse spacing between the first pair of tabs 61 and the width of the inner vertical wall 56 are both less than the spacing between parallel sections 46 and 48, so movement is permitted. However, if movement of wedge bar 36 continues, interconnecting section 50 eventually contacts the pair of tabs 61, and is prevented from further movement toward the second end wall 34 of the casket 10. This corresponds to the rollers 28 being out of engagement with the catches 38, so that the lid 14 may be lifted with respect to the body 12. When the screw 68 is rotated in the opposite direction, so that the wedge bar 36 moves toward first end wall 32 to lock the lid 14 to the body 12, interconnecting section 50 eventually contacts the outer pair of tabs 63 and is prevented from further movement. This corresponds to complete camming down of the rollers 28 by the catches 38, when the lid 14 is locked to the body 12.

Thus, the three-component mechanism structure shown in FIGS. 3 and 4 effectively moves the wedge bar 36 along its axis as needed to lock and unlock the lid 14 of the casket 10 to the body 12 of the casket 10. Namely, these components threadably engage the wedge bar 36 to convert rotational movement of screw 68 into longitudinal movement of the wedge bar 36. These components also: 1) restrict the wedge bar 36 from twisting during longitudinal movement; 2) limit longitudinal over-travel of the wedge bar 36 in both the locked and unlocked directions; 3) prevent axial and radial movement of the screw 68; and 4) provide a bearing surface between the rotatable screw 68 and the nonrotatable components, for smooth and quiet operation, with reduced rust buildup.

One primary advantage of this invention relates to the ability of this wedge bar locking mechanism to provide all of these necessary features with a minimal number of parts, Excluding the wedge bar 36 and mounting screws, these features are provided by only three other components, i.e. the bracket 54, the screw 68 and the clip 78. In contrast, the prior art described in the background section required seven parts.

Because of this reduction in the number of necessary components, and further because of the manner in which these particular parts interact, this invention significantly reduces the possibility for failure of the wedge bar mechanism used to lock and unlock a casket 10. Moreover, because of th minimal number of components, this invention reduces the time and cost associated with manufacturing and then assembling a wedge bar locking mechanism.

While a wedge bar locking mechanism in accordance with a preferred embodiment of the invention has been described, it is to be understood that the invention is not limited thereby and that in light of the present disclosure, various other alternative embodiments will be readily apparent to one of skill in the art without departing from the scope of the invention. Accordingly, applicant intends to be bound only by the following claims.

We claim:

1. A wedge bar locking mechanism in combination with a casket locking a lid of the casket to a body of the casket along a nonhinged edge, the casket having a wedge bar mounted to the body along the nonhinged edge, the wedge bar movable longitudinally toward and away from a first end wall of the casket to lock and to unlock the lid to the body, respectively, and the wedge bar having a first end adjacent the first wall, the mechanism comprising:

a screw located within the body adjacent the first end wall of the casket, the screw having a forward end, an externally threaded portion adjacent the forward end and operatively connected to the first end of the wedge bar so that rotational movement of the screw causes longitudinal movement of the wedge bar, the screw also having an enlarged diameter collar adjacent the threaded portion, a reduced diameter midportion adjacent the collar and a rearward portion adjacent the midportion, the forward end being spaced further from the first end wall of the casket than the rearward portion;

a bracket fixedly mounted to the body adjacent the first end wall, the bracket including inner and outer vertical walls and a center wall residing therebetween, the inner wall spaced further from the first end wall of the casket than the outer wall, the inner wall having a hole therein operatively engaged by the forward end of the screw, the outer wall having an open slot in which the midportion of the screw resides, with the collar and the rearward portion located on opposite sides of the outer wall; and a clip having a pair of spaced members joined along a first edge and an open slot through the members along an edge opposite the first edge, the clip removably secured to the outer wall of the bracket with the spaced members located on opposite sides of the outer wall and also located between the collar and the rearward portion of the screw, the open slot of the clip and the upwardly opening slot of the outer wall cooperatively encircling the midportion of the screw at the outer wall, whereby the bracket and the clip cooperate with the collar and the rearward portion of the screw to prevent axial and radial movement thereof.

2. The wedge bar locking mechanism of claim 1 wherein the wedge bar includes a section having an internally threaded hole which is in threaded engagement with the threaded portion of the screw.

3. The wedge bar locking mechanism of claim 1 and further comprising:

a pin located at the forward end of the screw, the pin receivably engaged by the hole in the inner wall of the bracket, thereby to restrict movement of the screw with respect to the inner wall of the bracket.

4. The wedge bar locking mechanism of claim 1 wherein the clip is of one-piece construction with the two members defined by a fold along the first edge.

5. The wedge bar locking mechanism of claim 4 wherein the clip is bronze.

6. The wedge bar locking mechanism of claim 1 wherein the first end of the wedge bar includes a pair of spaced end sections with an interconnecting section therebetween, and further comprising:

the center wall of the bracket oriented perpendicular to the end sections, located adjacent thereto, and having a width greater than the spacing between the end sections, whereby the center wall prevents rotational movement of the wedge bar during rotational movement of the screw.

7. The wedge bar locking mechanism of claim 6 wherein the center wall is oriented horizontally and the spaced sections are oriented vertically.

8. The wedge bar locking mechanism of claim 6 wherein the inner wall of the bracket has a width less than the spacing between the spaced end sections of the wedge bar, thereby to permit longitudinal movement of the wedge bar relative thereto, and the bracket further comprises:

a first pair of spaced integral tabs located adjacent the inner wall and a second pair of spaced integral tabs located adjacent the outer wall, each of the first and second pairs of tabs adapted to cooperate with the interconnecting section of the wedge bar to limit over-travel of the wedge bar away from and toward the first end wall of the casket, respectively, each of the pairs of tabs having a transverse spacing less than the spacing between the parallel end sections of the wedge bar so as to not contact said parallel sections.

9. A wedge bar locking mechanism in combination with a casket locking a lid of the casket to a body of the casket along a nonhinged longitudinal edge, the casket including a wedge bar mounted in the body along the nonhinged edge, the wedge bar movable longitudinally along a horizontal axis toward and away from a first end wall of the casket and cooperative with the lid to lock the casket when moved toward the first end wall and to unlock the casket when moved away from the first end wall, the wedge bar having a first end adjacent the first end wall, the first end including a pair of parallel spaced sections with an interconnecting section residing therebetween, the parallel sections being oriented perpendicular to the first end wall of the casket and the interconnecting section being oriented parallel therewith, the invention comprising:

a screw located within the body adjacent the first end wall and having a threaded portion thereof operatively connected to the interconnecting section of the wedge bar so that rotation of the screw causes movement of the wedge bar, the screw including a forward end adjacent the threaded portion, a rearward end and a reduced diameter midportion between the rearward end and the threaded portion, the forward end of the screw located further from the first end wall of the casket than the rearward end of the screw; and a bracket fixedly mounted to the body adjacent the first end wall, the bracket including inner and outer vertical walls and a center wall therebetween, the inner wall being further from the first end wall of the casket than the outer wall, the inner wall having a width less than the distance between the two parallel sections of the wedge bar, the inner wall and the outer wall operatively engaging the forward end and the rearward end of the screw, respectively, to prevent radial and axial movement of the screw during rotation thereof, the center wall of the bracket located adjacent the parallel sections of the wedge bar and oriented perpendicular thereto, and having a width greater than the distance between the parallel sections, whereby the center wall prevents twisting of the wedge bar upon rotation of the screw.

10. The wedge bar locking mechanism of claim 9 wherein the bracket further comprises:

an inner pair of spaced tabs located on the center wall and operative to coact with the interconnecting section to limit longitudinal over-travel of the wedge bar way from the first wall of the casket; and an outer pair of spaced tabs located on the center wall adjacent the outer wall and operative to coact with the interconnecting section to limit longitudinal over-travel of the wedge bar toward the first wall of the casket.

11. The wedge bar locking mechanism of claim 9 wherein the outer wall of the bracket includes an open slot in which the midportion of the screw is retained, and further comprising:

a clip removably connectable to the outer wall to encircle the midportion retained therein.

12. The wedge bar locking mechanism of claim 11 wherein the clip is bronze.

13. The wedge bar locking mechanism of claim 11 wherein the screw further comprises:

an integral collar located between the threaded portion and the rearward end and adjacent the midportion, the collar coacting with the clip, the rearward end of the screw and the outer wall of the bracket to prevent axial movement of the midportion of the screw retained therein.

14. The wedge bar locking mechanism of claim 9 wherein the wedge bar parallel sections and the interconnecting section are oriented vertically and the center wall is oriented horizontally.

15. A wedge bar locking mechanism in combination with a casket locking a lid of the casket to a body of the casket along a nonhinged longitudinal edge, the casket including a wedge bar mounted in the body along the nonhinged edge, the wedge bar movable longitudinally along a horizontal axis toward and away from a first end wall of the casket and cooperative with the lid to lock the casket when moved toward the first end wall and to unlock the casket when moved away from the first end wall, the wedge bar having a first end adjacent the first end wall, the first end including a pair of parallel spaced sections with an interconnecting section residing therebetween, the parallel sections being oriented perpendicular to the first end wall of the casket and the interconnecting section being oriented parallel therewith, the invention comprising:

a screw located within the body adjacent the first end wall and having a threaded portion thereof operatively connected to the interconnecting section of the wedge bar so that rotation of the screw causes movement of the wedge bar, the screw including a forward end and a rearward end located on opposite sides of the threaded portion, the forward end of the screw located further from the first end wall of the casket than the rearward end of the screw; and a bracket fixedly mounted to the body adjacent the first end wall, the bracket including inner and outer vertical walls and a center wall therebetween, the inner wall being further from the first end wall of the casket than the outer wall, the inner wall having a width less than the distance between the two parallel sections of the wedge bar, the inner wall and the outer wall operatively engaging the forward end and the rearward end of the screw, respectively, to prevent radial and axial movement of the screw during rotation thereof, the bracket further including a first pair of integral tabs located adjacent the inner wall and a second pair of tabs located adjacent the outer wall, each pair of tabs having a transverse width less than the spacing between the parallel sections of the wedge bar, the first and second pairs of tabs adapted to cooperate with the interconnecting section to limit over-travel of the wedge bar in the unlocked and locked positions, respectively.

* * * * *